US010436042B2

(12) United States Patent
Serra et al.

(10) Patent No.: US 10,436,042 B2
(45) Date of Patent: Oct. 8, 2019

(54) THERMAL BARRIER COATINGS AND METHODS

(71) Applicant: United Technologies Corporation, Hartford, CT (US)

(72) Inventors: Jessica L. Serra, Vernon, CT (US); Brian T. Hazel, Avon, CT (US)

( * ) Notice: Subject to any disclaimer, the term of this patent is extended or adjusted under 35 U.S.C. 154(b) by 316 days.

(21) Appl. No.: 14/955,812

(22) Filed: Dec. 1, 2015

(65) Prior Publication Data

US 2017/0152753 A1 Jun. 1, 2017

(51) Int. Cl.

| | |
|---|---|
| ***C23C 4/134*** | (2016.01) |
| ***F01D 5/28*** | (2006.01) |
| ***C23C 4/04*** | (2006.01) |
| ***F01D 5/18*** | (2006.01) |
| ***F01D 9/04*** | (2006.01) |
| ***F01D 25/08*** | (2006.01) |
| ***C23C 28/00*** | (2006.01) |
| ***C23C 4/11*** | (2016.01) |

(52) U.S. Cl.

CPC ..... *F01D 5/288* (2013.01); *C23C 4/04* (2013.01); *C23C 4/11* (2016.01); *C23C 4/134* (2016.01); *C23C 28/3215* (2013.01); *C23C 28/3455* (2013.01); *F01D 5/187* (2013.01); *F01D 9/041* (2013.01); *F01D 25/08* (2013.01); *F05D 2220/32* (2013.01); *F05D 2230/90* (2013.01); *F05D 2240/80* (2013.01); *F05D 2260/231* (2013.01); *F05D 2300/611* (2013.01)

(58) Field of Classification Search

CPC ..... F01D 5/288; F01D 5/187; F01D 9/041; F01D 25/08; F05D 2220/32; F05D 2230/90; F05D 2260/231; F05D 2300/611; C23C 4/134; C23C 4/04; C23C 14/083; C23C 22/361

USPC ..... 415/200

See application file for complete search history.

(56) References Cited

U.S. PATENT DOCUMENTS

| | | | |
|---|---|---|---|
| 4,411,940 | A | 10/1983 | Derkacs et al. |
| 6,390,383 | B1 | 5/2002 | Fusaro, Jr. et al. |
| 7,625,172 | B2 | 12/2009 | Walz et al. |

(Continued)

FOREIGN PATENT DOCUMENTS

| | | | |
|---|---|---|---|
| EP | 1686199 | A2 | 8/2006 |
| WO | 2014126633 | A2 | 8/2014 |

(Continued)

OTHER PUBLICATIONS

VaBen, et al "Advanced thermal spray technologies for applications in energy systems" Surface & Coatings Technology 202 (2008) pp. 4432-4437.*

(Continued)

*Primary Examiner* — Justin D Seabe
*Assistant Examiner* — Brian Christopher Delrue
(74) *Attorney, Agent, or Firm* — Bachman & LaPointe, P.C.

(57) ABSTRACT

In a method for coating an airfoil member, the airfoil member comprises: a platform having a surface; and an airfoil having an end at the platform surface. The method comprises applying, via suspension plasma spray or solution plasma spray, a ceramic coating: to the airfoil with a first average coating thickness; and to the platform surface with a second average thickness at least 90% of the first average thickness.

20 Claims, 3 Drawing Sheets

(56) References Cited

U.S. PATENT DOCUMENTS

| | | | | |
|---|---|---|---|---|
| 8,191,504 | B2 * | 6/2012 | Blankenship | B05B 13/0431 118/300 |
| 8,586,172 | B2 * | 11/2013 | Rosenzweig | C23C 30/00 428/195.1 |
| 8,920,882 | B2 | 12/2014 | Halberstadt et al. | |
| 9,816,392 | B2 * | 11/2017 | Parakala | F01D 25/005 |
| 9,850,566 | B2 * | 12/2017 | Zimmermann | C23C 4/04 |
| 2008/0057213 | A1 * | 3/2008 | Wortman | C23C 4/04 427/448 |
| 2008/0187676 | A1 | 8/2008 | Blankenship | |
| 2010/0154422 | A1 * | 6/2010 | Kirby | C04B 41/009 60/722 |
| 2011/0151219 | A1 * | 6/2011 | Nagaraj | F23R 3/007 428/215 |
| 2013/0224453 | A1 * | 8/2013 | Hazel | C23C 4/02 428/212 |
| 2014/0065361 | A1 | 3/2014 | Rosenzweig et al. | |
| 2014/0272456 | A1 | 9/2014 | Trubelja et al. | |
| 2014/0287149 | A1 | 9/2014 | Zimmermann et al. | |
| 2015/0140284 | A1 * | 5/2015 | Mantkowski | F01D 25/005 428/195.1 |
| 2015/0167141 | A1 * | 6/2015 | Rosenzweig | C23C 4/127 428/195.1 |
| 2015/0233256 | A1 * | 8/2015 | Anand | F01D 5/284 428/623 |
| 2016/0186580 | A1 * | 6/2016 | Zaleski | C23C 4/11 428/332 |

FOREIGN PATENT DOCUMENTS

| | | | | |
|---|---|---|---|---|
| WO | WO 2014126633 | A2 * | 8/2014 | C23C 4/02 |
| WO | 2014/143363 | A1 | 9/2014 | |

OTHER PUBLICATIONS

VanEvery, et al "In-Flight Alloying of Nanocrystalline Yttria-Stabilized Zirconia Using Suspension Spray to Produce Ultra-Low Thermal Conductivity Thermal Barriers", International Journal of Applied Ceramic Technology, 8[6], 1382-1392 (2011), first published online Dec. 17, 2010.*

K. VanEvery et al., Journal of Thermal Spray Technology vol. 20(4) Jun. 2011—817.*

Holger Kassner et al., Application of Suspension Plasma Spraying (SPS) for Manufacture of Ceramic Coatings, Journal of Thermal Spray Technology, Mar. 2008, pp. 115-123, vol. 17(1).*

K. Bareford, Final Office Action—U.S. Appl. No. 13/408,460, dated Mar. 25, 2014.*

Juan Antonio Garcia Marin, "New concepts in automation and robotic technology for surface engineering", Master Thesis, Institute for Manufacturing Technologies of Ceramics Components and Composites—IMTCCC, University of Stuttgart, Jul. 2010 (Year: 2010).*

Neal A. Seegmiller, Jonathan A. Bailiff and Ron K. Franks; Lockheed Martin Aeronautics Company, Copyright 2009 SAE International; "Precision Robotic Coating Application and Thickness Control Optimization for F-35 Final Finishes" (Year: 2009).*

Kinematic Optimization of Robot Trajectories for Thermal Spray Coating Application; Journal of Thermal Spray Technology; Dec. 2014 (Year: 2014).*

Kent Vanevery et al., Column Formation in Suspension Plasma-Sprayed Coatings and Resultant Thermal Properties, Journal of Thermal Spray Technology, Jun. 2011, pp. 817-828, vol. 20(4), ASM International, Materials Park, OH 44073-0002.

European Search Report dated Mar. 28, 2017 for EP Patent Application No. 16201547.3.

European Office Action dated Jul. 3, 2018 for European Patent Application No. 16201547.3.

* cited by examiner

THERMAL BARRIER COATINGS AND METHODS

BACKGROUND OF THE INVENTION

The invention relates to coating of high temperature components. More particularly, the invention relates to coating gas turbine engine vanes and blades.

In the aerospace industry, a well-developed art exists regarding the cooling of components such as gas turbine engine components. Exemplary components are gas turbine engine blades and vanes. Exemplary blade and vane airfoils are cooled by airflow directed through the airfoil to be discharged from cooling holes in the airfoil surface. Also, there may be cooling holes along the vane shroud or vane or blade platform. The cooling mechanisms may include both direct cooling as the airflow passes through the component and film cooling after the airflow has been discharged from the component but passes downstream close to the component exterior surface.

By way of example, cooled vanes are found in U.S. Pat. Nos. 5,413,458, 5,344,283 and 7,625,172 and U.S. Application Publication 20050135923.

Exemplary cooled vanes are formed by an investment casting of a high temperature alloy (e.g., nickel- or cobalt-based superalloy). The casting may be finish machined (including surface machining and drilling of holes/passageways). The casting may be coated with a thermal and/or erosion-resistant coating.

Exemplary thermal barrier coatings include two-layer thermal barrier coating systems. An exemplary system includes an NiCoCrAlY bond coat (e.g., low pressure plasma sprayed (LPPS)) and a yttria-stabilized zirconia (YSZ) barrier coat (e.g., air plasma sprayed (APS) or electron beam physical vapor deposited (EB-PVD)).

U.S. Pat. No. 8,191,504 of Blankenship, issued Jun. 5, 2012, and entitled "Coating Apparatus and Methods", discloses use of a robot for plasma spray of thermal barrier coatings.

SUMMARY OF THE INVENTION

One aspect of the invention involves a method for coating an airfoil member. The airfoil member comprises: a platform having a surface; and an airfoil having an end at the platform surface. The method comprises applying, via suspension plasma spray or solution plasma spray, a ceramic coating: to the airfoil with a first average coating thickness; and to the platform surface with a second average thickness at least 90% of the first average thickness.

In one or more embodiments of any of the other embodiments, the applying is via suspension plasma spray.

In one or more embodiments of any of the other embodiments, the airfoil member is a vane and the platform is an inner diameter (ID) platform and the airfoil member further comprises a shroud having an inboard surface, the airfoil having an outboard end at the shroud inboard surface.

In one or more embodiments of any of the other embodiments, the applying is to a third average thickness at least 90% of the first average thickness along the shroud inboard surface.

In one or more embodiments of any of the other embodiments, the second average thickness is at least 100% of the first average thickness.

In one or more embodiments of any of the other embodiments, the second average thickness is at least 110% of the first average thickness.

In one or more embodiments of any of the other embodiments, the second average thickness is 90% to 150% of the first average thickness.

In one or more embodiments of any of the other embodiments, the second average thickness is at least 125 micrometers.

In one or more embodiments of any of the other embodiments, the second average thickness is 125 micrometers to 375 micrometers.

In one or more embodiments of any of the other embodiments, the coating is applied by a robot.

In one or more embodiments of any of the other embodiments, the suspension plasma spray involves maintaining an axis of the spray spaced from the airfoil while spraying the platform.

In one or more embodiments of any of the other embodiments, the ceramic is a yttria-stabilized zirconia and/or a gadolina-stabilized zirconia.

In one or more embodiments of any of the other embodiments, the method is performed by a robot. The robot is programmed to maintain an axis of the spray spaced from the airfoil while spraying the platform.

Another aspect of the invention involves an airfoil member comprising: a platform having a surface; an airfoil having an end at the platform surface; and a columnar structured ceramic coating. The coating has a first average coating thickness along the airfoil; and a second average thickness at least 90% of the first average thickness along the platform surface.

In one or more embodiments of any of the other embodiments, along a portion of the platform surface extending 10 millimeters from the airfoil, the coating has an average thickness of at least 70% of the first average thickness.

In one or more embodiments of any of the other embodiments, the second average thickness is 90% to 150% of the first average thickness.

In one or more embodiments of any of the other embodiments, the ceramic coating comprises a yttria-stabilized zirconia and/or a gadolina-stabilized zirconia.

In one or more embodiments of any of the other embodiments, the airfoil member is a vane and the platform is an inner diameter (ID) platform and the airfoil member further comprises a shroud having in inboard surface, the airfoil having an outboard end at the shroud inboard surface.

In one or more embodiments of any of the other embodiments, the ceramic coating has a third average thickness at least 90% of the first average thickness along the shroud inboard surface.

In one or more embodiments of any of the other embodiments, the ceramic coating comprises suspension plasma-sprayed coating.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

Figure 2:
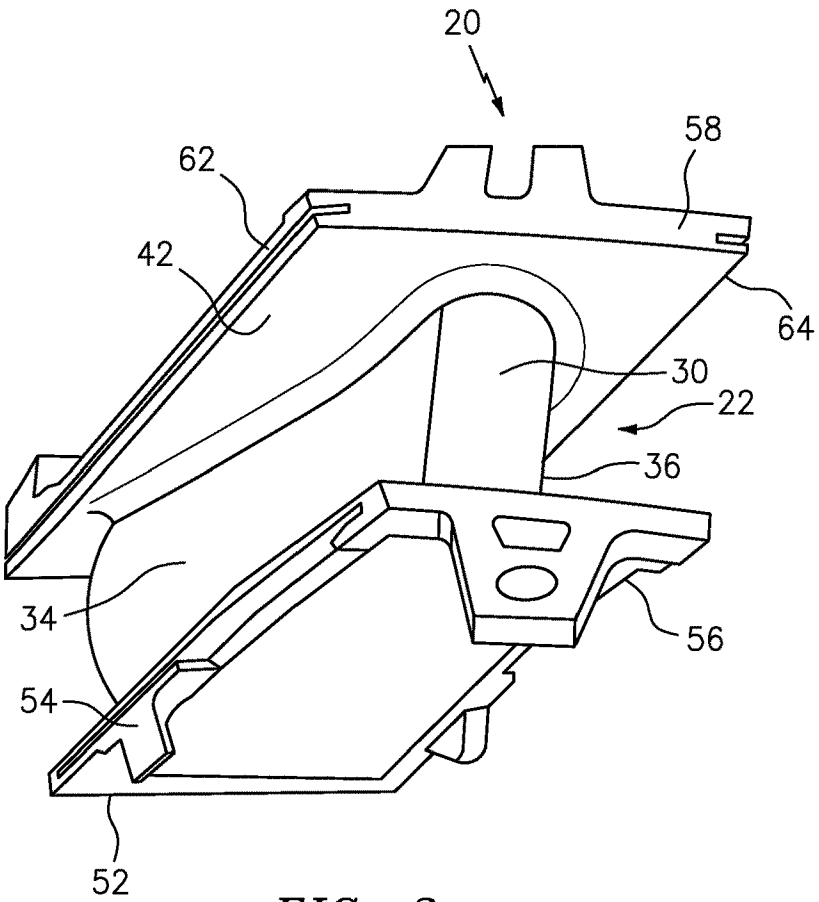
FIG. 2 is a second view of the vane.
Figure 1:
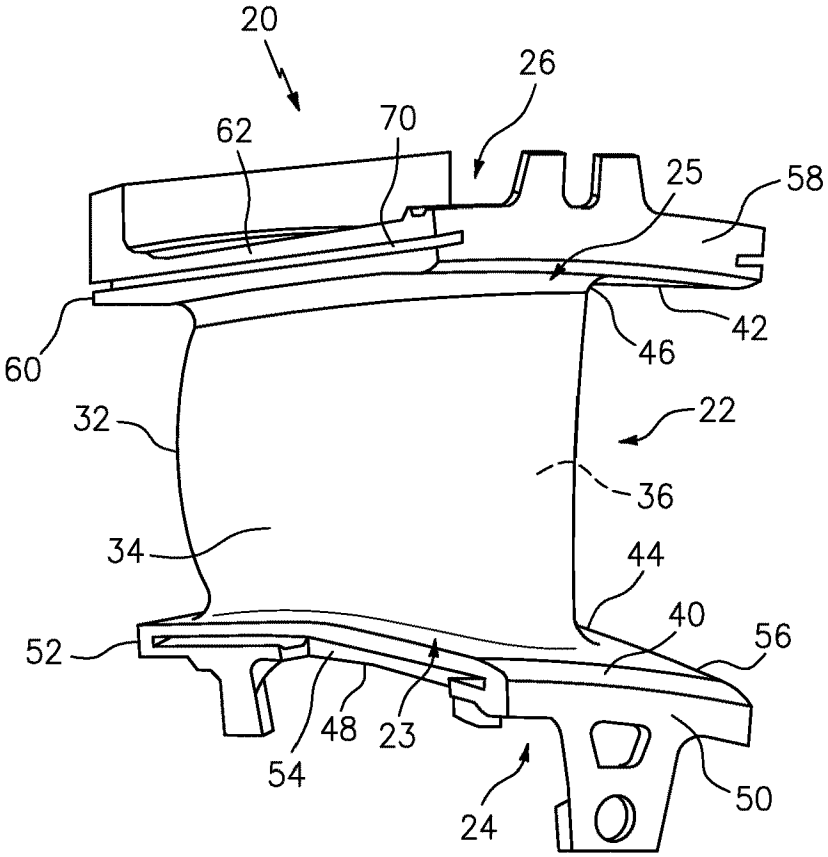
FIG. 1 is a first view of a vane.

FIGS. 1 and 2 show an exemplary vane (a singlet) 20 having an airfoil 22 extending from an inboard end 23 at a platform segment (platform or inner diameter (ID) platform) 24 to an outboard end 25 at a shroud segment 26 (shroud—alternatively referred to as an outer diameter (OD) platform).

The airfoil has a leading edge 30 and a trailing edge 32. A pressure side 34 and a suction side 36 extend from the leading edge 30 to the trailing edge 32. The platform 24 has a gaspath-facing outer diameter (OD) or outboard surface 40. The shroud 26 has a gaspath-facing inner diameter (ID) or inboard surface 42. Respective ID and OD fillets 44 and 46 may be formed at the junctions of the airfoil 22 with the platform 24 and shroud 26.

An underside 48 of the platform segment 24 may include features for mounting each platform segment 24 to its adjacent segments (e.g., by bolting to a ring). The platform segment 24 has a forward/upstream end 50, a rear/downstream end 52, and first and second circumferential ends or matefaces 54 and 56. Similarly, the shroud segment 26 has an upstream end 58, a downstream end 60, and first and second circumferential ends 62 and 64. Each of the platform circumferential ends 54, 56 and the shroud circumferential ends 62, 64 may include a groove or channel 70 for receiving a seal (not shown). A given such seal spans the gap between the adjacent grooves of each adjacent pair of vanes. Vane clusters (doublets and so forth) may be similarly formed with multiple airfoils between a given platform segment and shroud segment. Unless otherwise specified, the term "vane" includes singlets and clusters. The broader generic term "airfoil members" is applied to include both vanes and blades.

Cooling passageways may extend through the airfoil and the platform and/or shroud. In some configurations, cooling passageway legs may extend through the airfoil from one or more inlets in the platform underside or shroud outer diameter (OD) surface. Cooling outlets may include a trailing edge discharge slot (not shown) and outlet holes (not shown) along a remainder of the airfoil and portions of the platform and shroud.

The vane comprises a cast metallic (e.g., nickel-based superalloy) substrate and one or more coating systems along portions of the surface of the casting. The substrate may involve conventional or yet-developed materials, configurations, and manufacture techniques.

Figure 3:
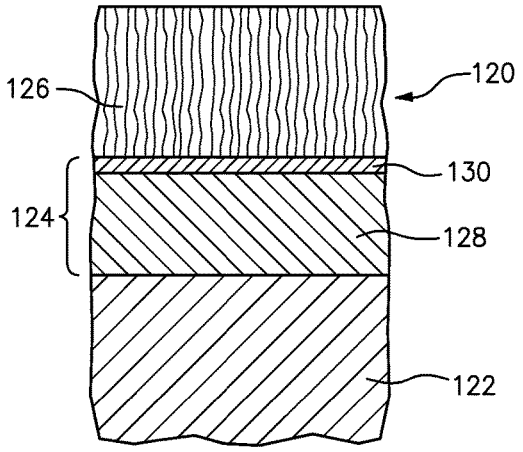
FIG. 3 is a schematic sectional view of a thermal barrier coating system on a substrate of the vane.

An exemplary configuration places a thermal barrier coating (TBC) system along the airfoil exterior surface and the gaspath-facing surfaces of the platform and shroud. FIG. 3 shows a coating system 120 atop the substrate 122. The system 120 may include a bond coat 124 atop the substrate 122 and a ceramic TBC 126 atop the bond coat 124. The term TBC is alternatively used in the art to identify just the ceramic TBC 126 and the entire system 120.

The exemplary bond coat 124 includes a base layer 128 and a thermally grown oxide (TGO) layer 130. The base layer and TGO layer may originally be deposited as a single precursor layer. There may be diffusion with the substrate. The TGO layer reflects oxidation of original material of the precursor. Exemplary base layer thicknesses are 10-400 micrometers, more narrowly 20-200 micrometers. Exemplary TGO layer thicknesses are 0.05-1 micrometers, more narrowly 0.1-0.5 micrometers. Exemplary TBC thicknesses are 40-800 micrometers, more narrowly 100-500 micrometers. Alternative bond coats include diffusion aluminides.

An exemplary coating process includes preparing the substrate (e.g., by cleaning and surface treating). A precursor of the bond coat is applied. An exemplary application is of an MCrAlY, more particularly a NiCoCrAlY material. An exemplary application is via a spray from a powder source. Exemplary application is via a high-velocity oxy-fuel (HVOF) process or a low pressure plasma spray (LPPS) process. An exemplary application is to a thickness of 0.003-0.010 inch, (76-254 micrometers) more broadly 0.001-0.015 inch (25-381 micrometers). LPPS, VPS, EB-PVD, cathodic arc, cold spray, and any other appropriate process may be used.

After the application, the precursor may be diffused. An exemplary diffusion is via heating (e.g., to at least 1900° F. (1038° C.) for a duration of at least 4 hours) in vacuum or nonreactive (e.g., argon) atmosphere. The exemplary diffusion may create a metallurgical bond between the bond coat and the substrate. Alternatively diffusion steps may occur after applying the TBC, if at all.

After application of the bond coat precursor, if any, the substrate may be transferred to a coating apparatus for applying the TBC 126. An exemplary TBC comprises a single ceramic layer of a single nominal composition. Multilayer and graded composition embodiments are also possible. Exemplary material is a stabilized zirconia such as a yttria-stabilized zirconia (YSZ). An exemplary YSZ is 7YSZ.

At least the one layer of the TBC 126 is applied by suspension plasma spray or solution plasma spray. The spraying may be performed by a spray robot (e.g., six-axis robot) carrying the spray gun. The robot may be computer controlled with preprogrammed path configured to provide a desired coating distribution (discussed below).

Prior art EB-PVD deposition of the ceramic has been observed to yield a coating distribution poorly suited to vanes and blades. EB-PVD tends to form single crystal columns separated by defined gaps. This results in desirably strain-tolerant coatings. Such columnar coatings are distinguished from the splat structure associated with conventional air plasma spray (APS). However, EB-PVD is a line-of-sight process so that the surface to be coated needs to be oriented toward the evaporating pool. This provides a challenge when needing to coat surfaces normal to each other (or other large angular differences). For example, the airfoil surface is essentially perpendicular to the gaspath-facing surfaces of the platform and shroud, as shown in FIGS. 1 and 2.

Various problems can arise from this. For example, achieving sufficient coating thickness on the platform without getting too much on the airfoil may be problematic. Normally a blade or vane is oriented so the airfoil is perpendicular to the evaporating axis of the EB-PVD melt pool (consequently the platform and shroud gaspath-facing surfaces are parallel to the evaporating axis of the pool) to maximize the deposition rate on the airfoil. To get coating on the platform and shroud, however, the part must be tilted so that the platforms receive some impinging vapor from the pool. Coating thickness build rate is a function of the angle of the surface to the evaporating axis of the pool (the viewing angle). As the viewing angle increases, the coating flux to that surface also increases thereby increasing the build rate of the coating. Some modern EB-PVD equipment allows the part to be tilted by about 40° in either direction to accommodate platform and shroud coating. Even at this angle the airfoil may continue to experience a higher coating deposition rate than the platform and shroud. Thus coating thickness along the platform and shroud does not meet or exceed the thickness of the coating thickness on the airfoil. Generally the platform and shroud will get about half of the coating thickness of the airfoil by the tilting method. That means the platform and shroud cannot perform at the same level (as defined by maximum coating surface temperature) as an airfoil with this coating. U.S. Pat. No. 7,625,172 cites the platform as of particular importance. However, similar problems may attend the shroud depending on particular vane configurations. This has required a compromise in design such as adding additional cooling air to the platform or increasing platform coating thickness by a secondary process.

A further detriment related to the platform versus airfoil coating thickness issue may occur with respect to different types of airfoils, such as on turbine blades as distinguished from vanes. To get coating on a turbine blade platform via EB-PVD, the platform needs to be tilted to receive vapor flux from the evaporating pool as defined above. However, this tilt now brings the blade airfoil tip or outboard end closer to the evaporating pool than is the airfoil base or inboard end (base being near the platform). Deposition rate is also driven by distance from the source so that airfoil coating thickness will be thicker nearer the tip than nearer the base.

This tipward bias of coating distribution may have negative effects. For example, the part will need to be coated longer to achieve the minimum required coating thickness for the base of the airfoil. Further, the thicker coating on the tip of the blade will increase the pull load of the part when rotating. This higher pull load will reduce the creep life of the part and may require additional cooling to reduce the part temperature to offset this effect. Some alternative blades have tip shrouds. These raise considerations similar to the shrouds of vanes.

So-called cantilevered vanes lack an ID platform but have an OD platform or shroud. Thus they present highly similar geometrical considerations to blades when applying coating. Like conventional vanes, they may also be formed as either singlets or clusters. Cooling issues may be similar to other blades and vanes. However, they do not have the rotational pull consideration that blades do.

To overcome the drawbacks of EB-PVD, suspension plasma spray (SPS) may provide a strain tolerant structure that has spallation life similar to EB-PVD. SPS is applied by a plasma gun so its coating build-up is on a narrow footprint of aim of the plasma gun contrasted with the less defined EB-PVD plume. However, the way the SPS coating interacts and builds upon the surface is dependent on plasma gas flow and its interaction with the part surface. This is because the powders used in SPS are generally submicron in size and are readily moved by the gas flows. See, K. VanEvery, M. J. M. Krane, R. W. Trice, H. Wang, W. Porter, M. Besser, D. Sordelet, J. Ilaysky, and J. Almer, "Column Formation in Suspension Plasma-Sprayed Coatings and Resulting Thermal Properties", J. Therm. Spray Technol., June, 2011, 20(4), p 817-828, ASM International, Materials Park, Ohio. Regarding general SPS properties, see, U.S. Pat. No. 8,586,172, of Rosenzweig et al., Nov. 19, 2013, and entitled "Protective coating with high adhesion and articles made therewith" (although identifying suspension plasma spray as a form of APS without using the term "suspension plasma spray"). This enables some non-line-of-sight deposition so that the coating can build on surfaces angled and even normal to each other. The gas flow-driven deposition yields columnar structures resembling those of EB-PVD. SPS columnar structure is less dependent on viewing angle than EB-PVD and also can allow individually targeted platform passes vs airfoil passes to create location-specific columns closer to normal growth than in EB-PVD. This means in addition to general coating thickness increase on the platform there may also be more durability.

Therefore, SPS offers new degrees of freedom for tailoring coating thickness by location while maintaining a strain tolerant coating microstructure needed for modern applications. This is distinguished from conventional plasma spray wherein larger powders have essentially ballistic trajectory relatively uninfluenced by diverted gas flows. The gas flow may be optimized to make beneficial use of this effect. For example, angling the gun (and spray axis) off-normal to the part surface will create an asymmetric gas flow (also influenced by part geometry beyond the point of intersection of the axis with the part surface). Although some angling may be required by access of the spray gun and to avoid shadowing (e.g. of one platform by the other) additional angling may be provided to desired deposition away from the axis beyond the normal spray footprint.

Solution plasma spray also offers similar benefits. The solution droplet size will influence particle size. The small droplets contain a small amount of solute. As the solvent vaporizes off or burns, the solute may form into a small particle to be deposited. Such particles are still small when compared with conventional plasma spray particles and thus may be carried off line-of-sight.

Figure 7:
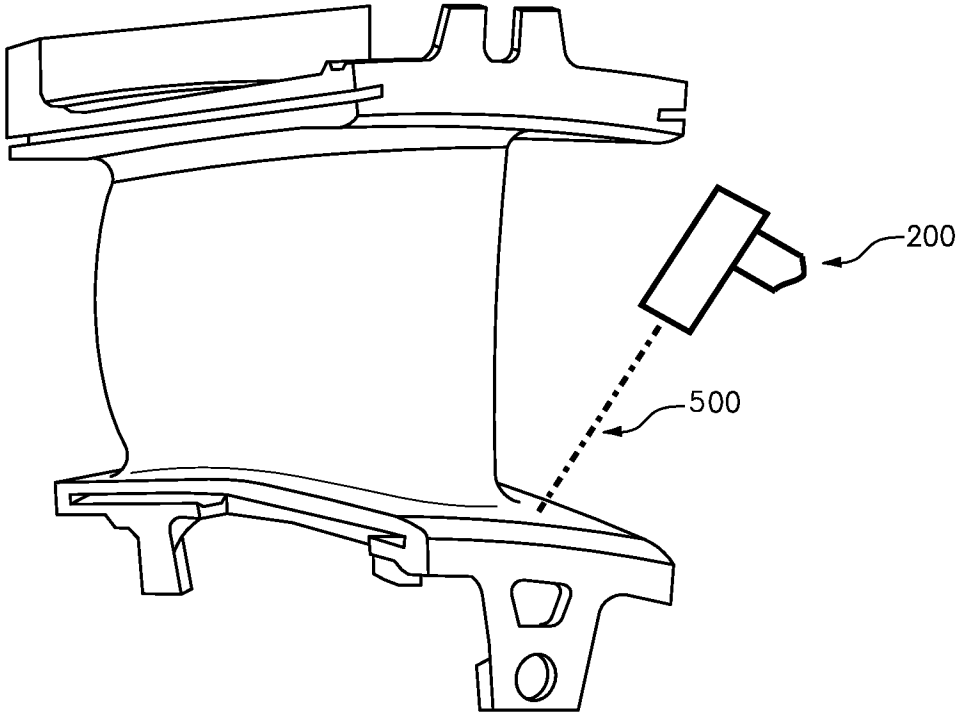
FIG. 7 is a schematicized view of a robot applying coating to a platform of the vane.

In one example of SPS, a robot 200 (e.g., schematically shown in FIG. 7 with arm cut away) is programmed to aim and maneuver the spray gun to apply a desired thickness distribution on the gaspath-facing surfaces of the platform and/or the shroud. At exemplary spray parameters, the footprint of the deposition spot is about 25 mm to 40 mm in diameter. When spraying the gaspath-facing surfaces the axis 500 of the spray and center of this footprint may be kept slightly away from the fillet (e.g., by about 10 mm to 15 mm). Particles will nevertheless deposit on the fillet with good quality. Similarly, when spraying the airfoil, the spray axis and footprint center may be kept away from the fillet while still coating the fillet. This is contrasted with a conventional air plasma spray where the core of the spray footprint is traversed over the fillet area causing poor coating quality (low strain resistance) due to too great an off-normal angle of deposition over one or both of the airfoil and the gaspath-facing surface.

In conventional air plasma spray (APS), the large particles have essentially ballistic behavior. In contrast, solution plasma spray or suspension plasma spray particles are more greatly influenced by the associated gas flow. The gas flow is deflected by the surface at which the spray is directed, thus creating a broader, more Gaussian distribution than the APS. With a surface normal to the spray axis, as distance from the axis increases, columnar direction will incline toward the axis.

In conventional air plasma spray, the large particles have essentially ballistic behavior. If the spray is directed essentially normal to the airfoil, as the spray passes near the platform, particles will hit the platform with very low angles of incidence. This yields a very poor coating quality. In contrast, solution plasma spray or suspension plasma spray particles are more greatly influenced by the associated gas flow. With spray directed normal to the airfoil near the platform, gas is deflected by the airfoil along the airfoil toward the platform and then away from the airfoil along the platform. The initial deflection of this gas flow carries particles toward the platform and they are believed to deposit at an angle closer to normal than could be obtained by APS. They deposit and, combined with corresponding passes on the platform, form columns closer to normal with coating quality at the transition between airfoil and platform better than could be obtained by APS.

Thus the passes along the airfoil may produce quality coating near the fillet than can APS.

Additional considerations attend coating passes aimed along the platform surfaces. When coating the platform surfaces via APS, or solution or suspension plasma spray, the other platform will block a highly normal spray. Thus spray may be at an angle of about 30° off-normal. With APS, the periphery of this spray will produce poor coating on the airfoil. Thus there is a tradeoff between two undesirable results: lack of coating near the fillet; and poor quality coating near the fillet. The poor quality results in a lack of strain tolerance.

Figure 4:
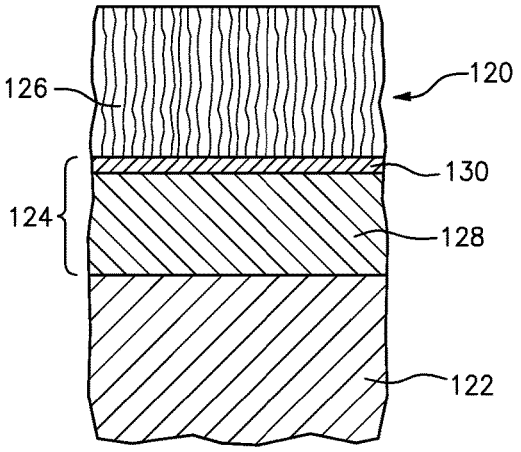
FIG. 4 is a schematic sectional view of a thermal barrier coating system on a substrate of the vane at a different location from FIG. 3.
Figure 5:
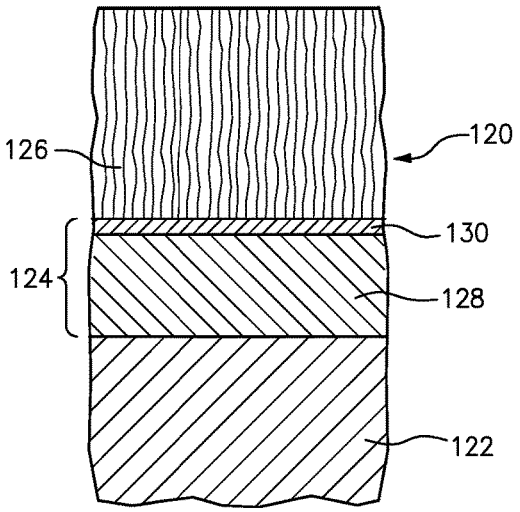
FIG. 5 is a schematic sectional view of a thermal barrier coating system on a substrate of the vane at a different location from FIG. 3.
Figure 6:
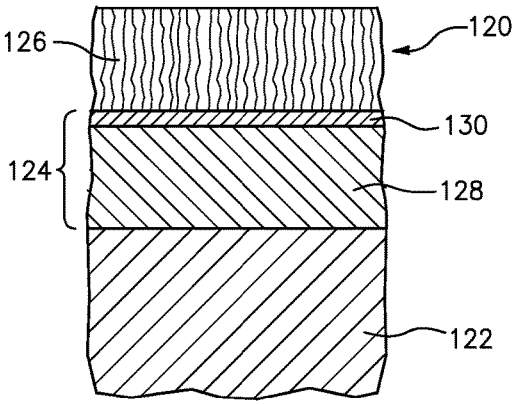
FIG. 6 is a schematic sectional view of a thermal barrier coating system on a substrate of the vane at a different location from FIG. 3.

Thus, one may build up coating on the gaspath-facing surfaces to the near equivalent thickness if not greater than the thickness along the airfoil (not achievable with EB-PVD) while maintaining strain-resistant coating quality (not available with APS). Exemplary average (mean, median, or modal) coating thickness on the gaspath-facing surfaces of the platform and/or shroud is at least 90% of that on the airfoil or at least 100% or at least 110% and up to an exemplary 200% or 150% or 120%. Exemplary thickness is 125 micrometers to 375 micrometers. Such thickness may be along substantially the entire gaspath-facing surface of the platform. Depending on the particular component, particular regions of the platform may be important. However, as a general matter the processes described hereinabove and hereinbelow may have particular benefit in providing a strain-tolerant coating in a zone near the fillet (e.g., a band of about 10 millimeters therefrom or about 5 millimeters therefrom. Such coating thicknesses may be achieved on the band. However, lower thickness thresholds might also be applicable (e.g., 70% of the average thickness along the airfoil). By way of example, to the extent that FIG. 3 represents an average coating 126 thickness along the airfoil, FIG. 4 shows a coating 126 along the band of the same thickness; FIG. 5 shows an increased thickness of the coating 126 at approximately said 150% of the baseline; and FIG. 6 shows a thickness of approximately said 70%.

This may be performed by depositing layers in staggered passes. For example, passes may be made generally streamwise along the airfoil. At respective extreme ID and OD passes, the axis may be kept appropriately away from the adjacent fillet (by a lateral offset) to just allow a perimeter portion of the spray carried by deflected gas to deposit on the adjacent platform surface. One or more intermediate passes may complete the layer. A subsequent layer may involve passes out of phase with the first layer. Such layers may alternate until a desired coating thickness is achieved. In some embodiments, lateral offset of the axis from the fillet or junction of the airfoil and platform may be in the range of 4.0 millimeter to 12.0 millimeter or 5.0 millimeters to 10.0 millimeters. Further, other lateral offsets may be employed, and, in some embodiments, may depend upon the configuration of the spray gun, the spraying configuration of the spray gun relative to the part, and/or configurations of other components of the spraying system.

The platform surfaces may be coated similarly, with a pass nearest the fillet having a similar lateral offset. The remainder of the layer may be performed with passes parallel thereto. The next layer may involve passes out of phase with those of the first layer. For a small platform, this may mean that the first layer involves two or three passes to each side of the airfoil and the second layer involves two or one, respectively. Such pairs of layers may alternate to form the desired thickness.

Graded or multi-layer coatings may be formed by using multiple suspension or solution sources. For example a graded coating varying from a first composition to a second may be achieved using two sources of the respective compositions and progressively varying the proportion from each layer of passes to the next. A two layer coating may be achieved by switching from one source to the other after building up sufficient pass layers of the first. An exemplary combination involves a YSZ and a gadolinia-stabilized zirconia (GSZ).

One or more embodiments of the present invention have been described. Nevertheless, it will be understood that various modifications may be made without departing from the spirit and scope of the invention. For example, the principles may be applied in the manufacturing of a variety of components. The principles may be applied to a variety of coatings and coating technologies. The principles may be applied in the modification of a variety of existing equipment. In such situations, details of the particular components, coating materials, coating technologies, and baseline equipment may influence details of the particular implementation. Accordingly, other embodiments are within the scope of the following claims.

What is claimed is:

1. A method for coating an airfoil member, the airfoil member comprising:

a platform having a surface; and an airfoil having an end at the platform surface, the method comprising applying a ceramic coating, via suspension plasma spray or solution plasma spray, to a bond coat:

to the airfoil with a first average coating thickness; and to the platform surface with a second average thickness at least 90% of the first average thickness, wherein:

the suspension plasma spray or solution plasma spray involves maintaining an axis of the spray spaced from the airfoil while spraying the platform and spaced from the platform while spraying the airfoil.

2. The method of claim 1 wherein the applying of the ceramic coating is via suspension plasma spray.

3. The method of claim 1 wherein the airfoil member is a vane and the platform is an inner diameter (ID) platform and the airfoil member further comprises:

a shroud having an inboard surface, the airfoil having an outboard end at the shroud inboard surface.

4. The method of claim 3 wherein the applying of the ceramic coating is to a third average thickness at least 90% of the first average thickness along the shroud inboard surface.

5. The method of claim 1 wherein:

the second average thickness is at least 100% of the first average thickness.

6. The method of claim 1 wherein:

the second average thickness is at least 110% of the first average thickness.

7. The method of claim 1 wherein:

the second average thickness is 90% to 150% of the first average thickness.

8. The method of claim 1 wherein:

the second average thickness is at least 125 micrometers.

9. The method of claim 1 wherein:

the second average thickness is 125 micrometers to 375 micrometers.

10. The method of claim 1 wherein:

the coating is applied by a robot.

11. The method of claim 1 wherein:

the axis of the spray is maintained spaced from the airfoil by at least 10 mm while spraying the platform and spaced from the platform by at least 10 mm while spraying the airfoil.

12. The method of claim 1 wherein:

the ceramic is a yttria-stabilized zirconia and/or a gadolina-stabilized zirconia.

13. The method of claim 1 performed by a robot wherein:

the robot is programmed to maintain an axis of the spray spaced from the airfoil while spraying the platform.

14. An airfoil member comprising:

a platform having a surface;

an airfoil having an end at the platform surface; and a suspension plasma sprayed or solution plasma sprayed columnar structured ceramic coating having:

a first average coating thickness along the airfoil; and a second average thickness at least 90% of the first average thickness along the platform surface.

15. The airfoil member of claim 14 wherein:

along a portion of the platform surface extending 10 millimeters from the airfoil, the coating has an average thickness of at least 70% of the first average thickness.

16. The airfoil member of claim 14 wherein:

the second average thickness is 90% to 150% of the first average thickness.

17. The airfoil member of claim 14 wherein:

the ceramic coating comprises a yttria-stabilized zirconia and/or a gadolina-stabilized zirconia.

18. The airfoil member of claim 14 wherein the airfoil member is a vane and the platform is an inner diameter (ID) platform and the airfoil member further comprises:

a shroud having in inboard surface, the airfoil having an outboard end at the shroud inboard surface.

19. The airfoil member of claim 18 wherein the ceramic coating has:

a third average thickness at least 90% of the first average thickness along the shroud inboard surface.

20. The airfoil member of claim 14 wherein:

the ceramic coating comprises suspension plasma-sprayed coating.

* * * * *